US010763625B2

(12) United States Patent
Whitlock

(10) Patent No.: US 10,763,625 B2
(45) Date of Patent: Sep. 1, 2020

(54) CONNECTOR WITH ELECTRICAL CONTACT FOR SHIELD TERMINATION DEVICE

(71) Applicant: THE BOEING COMPANY, Chicago, IL (US)

(72) Inventor: Neal Davis Whitlock, Edmonds, WA (US)

(73) Assignee: THE BOEING COMPANY, Chicago, IL (US)

( * ) Notice: Subject to any disclaimer, the term of this patent is extended or adjusted under 35 U.S.C. 154(b) by 56 days.

(21) Appl. No.: 16/104,009

(22) Filed: Aug. 16, 2018

(65) Prior Publication Data

US 2020/0059045 A1 Feb. 20, 2020

(51) Int. Cl.

| | |
|---|---|
| ***H01R 9/03*** | (2006.01) |
| ***H01R 13/6592*** | (2011.01) |
| ***H01R 43/26*** | (2006.01) |
| ***H01R 13/622*** | (2006.01) |

(52) U.S. Cl.

CPC ..... *H01R 13/6592* (2013.01); *H01R 13/622* (2013.01); *H01R 43/26* (2013.01)

(58) Field of Classification Search

CPC ... H01R 13/6592; H01R 13/622; H01R 43/26

USPC ..... 439/96, 98, 607.41

See application file for complete search history.

(56) References Cited

U.S. PATENT DOCUMENTS

| | | | | |
|---|---|---|---|---|
| 5,580,278 A * | 12/1996 | Fowler | H01R 13/622 | 439/607.23 |
| 7,252,536 B2 * | 8/2007 | Lazaro, Jr. | H01R 13/533 | 439/470 |
| 7,749,022 B2 * | 7/2010 | Amidon | H01R 13/6584 | 439/488 |
| 8,192,237 B2 * | 6/2012 | Purdy | H01R 24/40 | |

OTHER PUBLICATIONS

"Back Shell Definition," Electronic Engineering Dictionary Terms, <http://www.interfacebus.com/Glossary-of-Terms-Back-shell.html> retrieved Aug. 15, 2018, 3 pgs.

(Continued)

*Primary Examiner* — Khiem M Nguyen

(74) *Attorney, Agent, or Firm* — Moore Intellectual Property Law, PLLC

(57) ABSTRACT

An apparatus includes a wire harness including a primary conductor and a shield conductor configured to electromagnetically shield the primary conductor. The apparatus further includes a first connector coupled to the wire harness. The first connector includes a shield termination device electrically connected to the shield conductor. The first connector further includes a connector body defining a plurality of openings to receive a first plurality of electrical contacts. The first plurality of electrical contacts is configured to mate with a second plurality of electrical contacts of a second connector. A first electrical contact of the first plurality of electrical contacts is positioned in a first opening of the connector body and is electrically connected to the primary conductor. A second electrical contact of the first plurality of electrical contacts is positioned in a second opening of the connector body and is electrically connected to the shield termination device.

20 Claims, 9 Drawing Sheets

(56) References Cited

OTHER PUBLICATIONS

"What is a Cable Shield Termination?" InterConnect Wiring, <http://www.interconnect-wiring.com/blog/what-is-a-cable-shield-termination/> retrieved Aug. 15, 2018, 3 pgs.
"What is an Insert Arrangement?" InterConnect Wiring, <http://www.interconnect-wiring.com/blog/what-is-an-insert-arrangement/> retrieved Aug. 15, 2018, 3 pgs.

* cited by examiner

CONNECTOR WITH ELECTRICAL CONTACT FOR SHIELD TERMINATION DEVICE

FIELD OF THE DISCLOSURE

The present disclosure is generally related to shielding for conductors.

BACKGROUND

Electrical cables are used in aircraft and other applications to provide information from one component to another component. For example, sensors, controllers, and other devices of an airplane may each send and receive data using one or more electrical cables. The electrical cables may be grouped using a wire harness.

To prevent or reduce effects of electromagnetic interference, an electrical cable may be connected to a shield. As an illustrative example, in some implementations, a shield may isolate an electrical cable from effects of lightning or other electromagnetic signals that can damage aircraft equipment. A group of shields can be connected to a shield termination platform that "terminates" multiple connector shields (e.g., by connecting the group of shields to one or more components).

In some circumstances, a shield component may become loose, reducing effectiveness of the shield. As an example, a mechanical connection between a shield termination platform and one or more other components may loosen. In this circumstance, the shield may not function properly, which can result in components being exposed to electromagnetic interference.

SUMMARY

In a particular example, an apparatus includes a wire harness including a primary conductor and a shield conductor configured to electromagnetically shield the primary conductor. The apparatus further includes a first connector coupled to the wire harness. The first connector includes a shield termination device electrically connected to the shield conductor. The first connector further includes a connector body defining a plurality of openings to receive a first plurality of electrical contacts. The first plurality of electrical contacts is configured to mate with a second plurality of electrical contacts of a second connector. A first electrical contact of the first plurality of electrical contacts is positioned in a first opening of the connector body and is electrically connected to the primary conductor. A second electrical contact of the first plurality of electrical contacts is positioned in a second opening of the connector body and is electrically connected to the shield termination device.

In another particular example, an apparatus includes a primary conductor, a shield conductor configured to electromagnetically shield the primary conductor, and a first connector coupled to the primary conductor. The first connector includes a shield termination device electrically connected to the shield conductor. The first connector further includes a connector body defining a plurality of openings to receive a first plurality of electrical contacts. The first plurality of electrical contacts is configured to mate with a second plurality of electrical contacts of a second connector. The first connector further includes a first electrical contact of the first plurality of electrical contacts positioned in a first opening of the connector body and electrically connected to the primary conductor. The first connector further includes a second electrical contact of the first plurality of electrical contacts positioned in a second opening of the connector body and electrically connected to the shield termination device.

In another particular example, a method includes connecting a wire harness to a first connector that includes a plurality of electrical contacts configured to mate with a second plurality of electrical contacts of a second connector. The wire harness includes a primary conductor and a shield conductor that is attached to the primary conductor and to a shield termination device. The method further includes connecting a first electrical contact of the plurality of electrical contacts to the primary conductor. The method further includes connecting a second electrical contact of the plurality of electrical contacts to the shield termination device.

In another particular example, a method includes aligning a first plurality of electrical contacts of a first connector with a second plurality of electrical contacts of a second connector. The method further includes forming a first connection between a first electrical contact of the first plurality of electrical contacts and a corresponding first electrical contact of the second plurality of electrical contacts. The first electrical contact is coupled to a first primary conductor of a first wire harness, and the corresponding first electrical contact is coupled to a second primary conductor of a second wire harness. The method further includes forming a second connection between a second electrical contact of the first plurality of electrical contacts and a corresponding second electrical contact of the second plurality of electrical contacts. The second electrical contact is coupled to a first shield of the first primary conductor, and the corresponding second electrical contact is coupled to a second shield of the second primary conductor. Forming the second connection provides a first current path from a first shield termination device to a second shield termination device.

DETAILED DESCRIPTION

In a particular implementation, a wire harness is coupled to a connector having an electrical contact (e.g., a pin or a receptacle configured to receive a pin). The electrical contact is coupled (e.g., via a wire, such as a pigtail wire) to a shield termination device. Upon coupling the connector to another connector, the shield termination device is electrically coupled (e.g., via the wire and the electrical contact) to another shield termination of the other connector. As a result, if a mechanical connection between the shield termination device and another component is loosened, "shield-to-shield continuity" is maintained via the wire and the electrical contact.

Alternatively or in addition, in a particular example, the wire is coupled to a mechanical band. A plurality of shield conductors are connected to the mechanical band. As a result, the wire is electrically connected to the plurality of shield conductors at a first end of the wire. In a particular example, a second end of the wire is connected to the electrical contact (e.g., a pin or a socket configured to receive a pin). In another example, the second end of the wire is connected to a tab (instead of to the electrical contact). Connecting the wire to the tab instead of to an electrical contact may increase a number of electrical contacts available for other purposes, which may be beneficial in applications with low availability of pins or sockets.

Figure 1A:
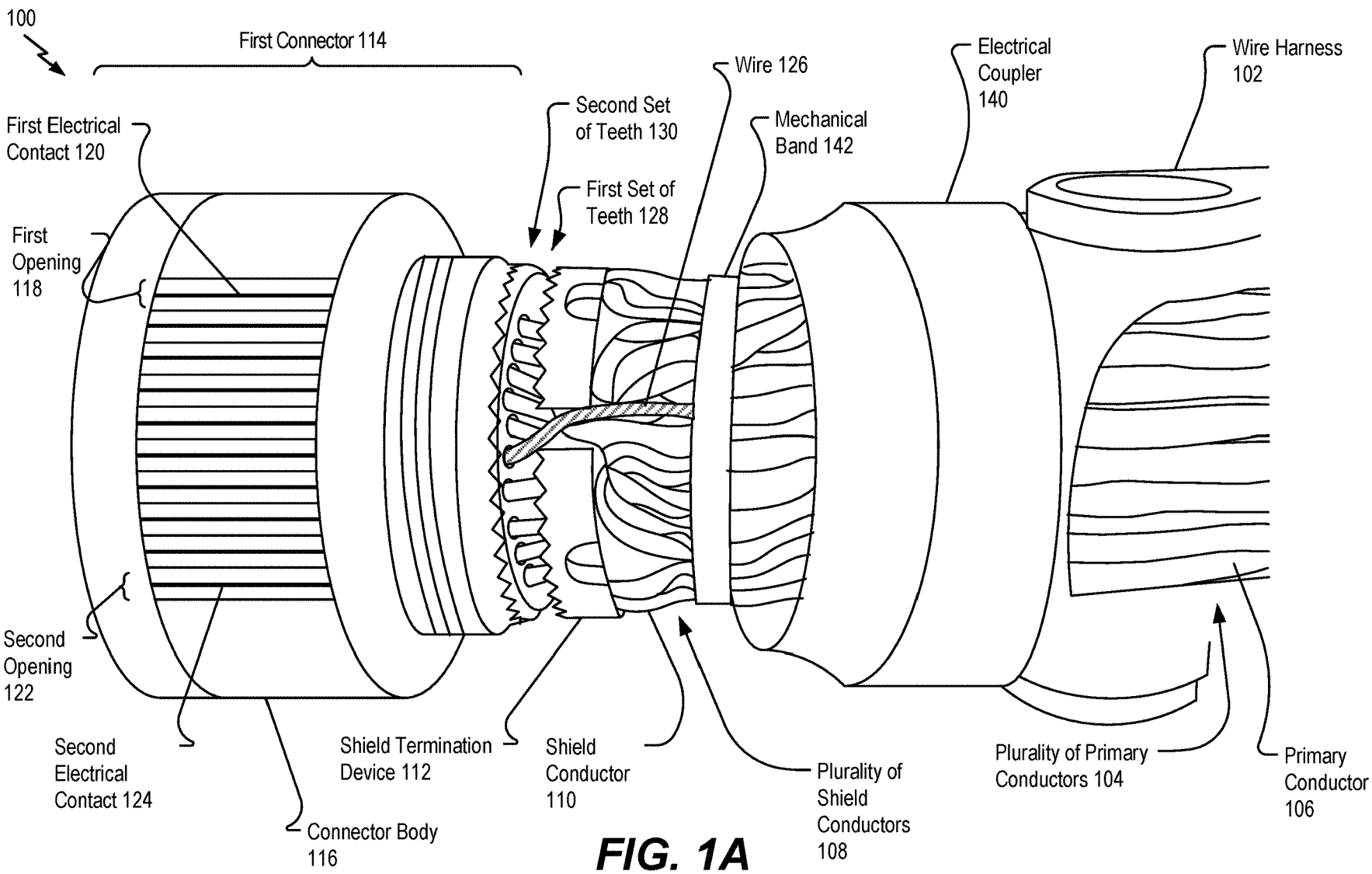
FIG. 1A is a diagram that illustrates aspects of an example of a connector including a contact coupled to a shield of a conductor.

Referring to FIG. 1A, an illustrative example of an apparatus is depicted and generally designated 100. In a particular illustrative example, the apparatus 100 is integrated within an electrical system of a vehicle, such as within an electrical system of an aircraft, as an illustrative example.

The apparatus 100 includes a wire harness 102 including a plurality of conductors, such as a plurality of primary conductors 104. To illustrate, FIG. depicts that the plurality of primary conductors includes a primary conductor 106. In various implementations, the plurality of primary conductors 104 include coaxial wires, twisted pair wires, twisted triple wires, single strand wires, optical conductors, or any other conductor configured to transmit a signal.

The wire harness 102 further includes a plurality of shields, such as a plurality of shield conductors 108. The plurality of shield conductors 108 is configured to shield the plurality of primary conductors 104. In one example, the plurality of shield conductors 108 is configured to shield the plurality of primary conductors 104 from interference from an external source, such as a radio transmitter. Alternatively or in addition, in another example, the plurality of shield conductors 108 is configured to shield the plurality of primary conductors 104 from a source that is internal to a vehicle that includes the apparatus 100. Alternatively or in addition, in another example, the plurality of shield conductors 108 is configured to shield effects of electromagnetic signals generated by the plurality of primary conductors 104.

To further illustrate, FIG. 1A depicts that the plurality of shield conductors 108 includes a shield conductor 110. The shield conductor 110 is configured to electromagnetically shield the primary conductor 106. As used herein, shielding the primary conductor 106 includes shielding the primary conductor 106 from electromagnetic signals generated by another component, shielding a component from electromagnetic signals generated by the primary conductor 106, or a combination thereof. In some examples, the shield conductor 110 includes a wire mesh configured to electromagnetically shield the primary conductor 106 from one or more of a lightning strike, a high-intensity electromagnetic field, an electromagnetic pulse, a radio signal, or another electromagnetic signal.

The apparatus 100 further includes a shield termination device 112 (also referred to as a "shield termination platform"). In some implementations, each shield conductor of the plurality of shield conductors 108 (including the shield conductor 110) is electrically connected to the shield termination device 112. For example, in some implementations, the plurality of shield conductors 108 is in contact with or is soldered to the shield termination device 112. In some implementations, the shield termination device 112 is coupled to one or more other components of a vehicle (e.g., an aircraft) that includes the apparatus 100, such as to a ground node or other component of the vehicle.

The apparatus 100 further includes a first connector 114. In some implementations, the first connector 114 is coupled to the wire harness 102. In some examples, the first connector 114 is coupled to the shield termination device 112. In a particular example, the shield termination device 112 includes a first set of teeth 128 configured to mate with a second set of teeth 130 of the first connector 114 (e.g., to mechanically connect the shield termination device 112 to the first connector 114, to electrically connect the shield termination device 112 to the first connector 114, or both).

In some implementations, the apparatus 100 further includes an electrical coupler 140. In some examples, the electrical coupler 140 is coupled to or included in the shield termination device 112. In some examples, the electrical coupler 140 is configured to secure the first set of teeth 128 to the second set of teeth 130 by keeping the first set of teeth 128 engaged with the second set of teeth, such as by screwing a ring or disc over the first set of teeth 128 and the second set of teeth 130 (after the first set of teeth 128 is connected to the second set of teeth 130).

The first connector 114 further includes a connector body 116. The connector body 116 defines a plurality of openings to receive a first plurality of electrical contacts configured to mate with a second plurality of electrical contacts of a second connector. As an example, FIG. 1A depicts that the plurality of openings includes a first opening 118 and a second opening 122. A first electrical contact 120 is positioned in the first opening 118, and a second electrical contact 124 is positioned in the second opening 122. To further illustrate, in some implementations, the connector body 116 has an insert arrangement configuration, where the plurality of openings of the connector body 116 are formed in an insert device that holds each contact of the plurality of electrical contacts of the connector body 116. The insert arrangement configuration may comply with one or more connector specifications that specify a number, arrangement, or type of contacts of the connector body 116.

At least one electrical contact of the connector body 116 is coupled to a primary conductor of the plurality of primary conductors 104. For example, the first electrical contact 120 is electrically connected to the primary conductor 106. In some implementations, each primary conductor of the plurality of primary conductors 104 is electrically connected to a respective electrical contact positioned in a corresponding opening of the connector body 116.

The second electrical contact 124 is electrically connected to the shield termination device 112. For example, in FIG. 1A, the apparatus 100 includes a wire 126 (illustrated with crosshatching) coupled to the second electrical contact 124 and to the shield termination device 112. In a particular example, the wire 126 electrically couples the second electrical contact 124 to each shield conductor of the plurality of shield conductors 108 via the shield termination device 112.

The wire 126 may have one or more characteristics selected to enable the wire 126 to discharge current from each shield conductor of the plurality of shield conductors 108. For example, in some implementations, the wire 126 has one or more of a size (e.g., gauge) or a material selected to enable the wire 126 to conduct current from each shield conductor of the plurality of shield conductors 108. In a particular example, the wire 126 and the second electrical contact 124 have sizes selected to provide a single current path for all shield conductors of the wire harness 102.

In some implementations, the wire 126 has a current carrying capacity that is selected based on current carrying capacities of shield conductors of the plurality of shield conductors 108. In a particular example, each shield conductor of the plurality of shield conductors 108 is associated with a current carrying capacity of N amperes (where N is a positive number), and the current carrying capacity of the wire 126 is greater than or equal to N*M amperes (where M is a positive integer indicating a number of shield conductors of the plurality of shield conductors 108).

Although the example of FIG. 1A illustrates a single wire 126 coupled to the shield termination device 112 and to the second electrical contact 124, in other implementations, one or more other wires or devices are coupled to the shield termination device 112 and to the second electrical contact 124 (alternatively or in addition to the wire 126). For example, in some implementations, multiple wires 126 are coupled to the shield termination device 112 and to the second electrical contact 124 (e.g., to increase an effective current carrying capacity of a path from the shield termination device 112 to the second electrical contact 124). Alternatively or in addition, multiple electrical contacts of the first connector 114 may be coupled to one or more wires 126 (e.g., to increase an effective current carrying capacity of a path from the shield termination device 112 through the first connector 114 and to a second connector).

The example of FIG. 1A also illustrates that in some implementations the apparatus 100 includes a mechanical band 142. In a particular example, each of the plurality of shield conductors 108 is connected to the mechanical band 142. For example, in some implementations, the plurality of shield conductors 108 are wrapped underneath and are coupled to the mechanical band 142. In the example of FIG. 1A, a first end of the wire 126 is coupled to the mechanical band 142, and a second end of the wire 126 is coupled to second electrical contact 124. In an alternative example, the second end of the wire 126 is coupled to a tab, as described with reference to FIG. 1B.

Figure 1B:
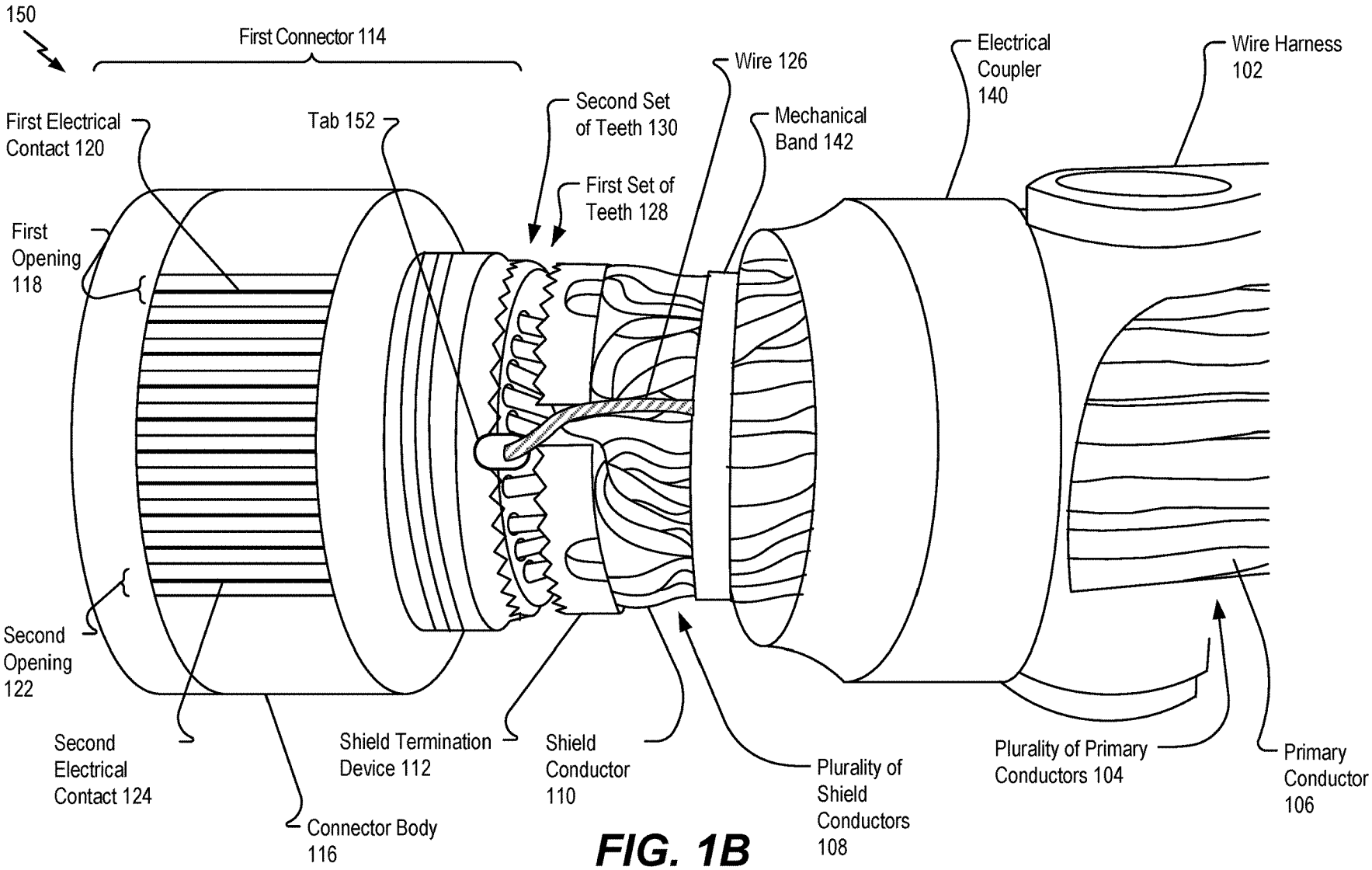
FIG. 1B is a diagram that illustrates aspects of an example of a connector with a wire having a first end that is connected to a mechanical band and a second end that is connected to a tab.

Referring to FIG. 1B, another illustrative example of an apparatus is depicted and generally designated 150. Certain features of the apparatus 150 may be as described with reference to the apparatus 100 of FIG. 1A.

In the example of FIG. 1B, the apparatus 150 includes a tab 152. In FIG. 1B, a first end of the wire 126 is coupled to the mechanical band 142 (e.g., as described with reference to the example of FIG. 1A). In the example of FIG. 1B, a second end of the wire 126 is coupled to a tab 152 (instead of to the second electrical contact 124). In some implementations, a first surface (e.g., a bottom surface) of the tab 152 is connected to the first connector 114 (e.g., via soldering, crimping, or press fitting, as illustrative examples), and a second surface (e.g., a top surface) of the tab 152 is connected to the second end of the wire 126 (e.g., via soldering, crimping, or press fitting, as illustrative examples).

In some implementations, aspects of either the apparatus 100 or the apparatus 150 may be selected based on availability of electrical contacts of the first connector 114. For example, the particular application is associated with unused (or "spare") electrical contacts of the first connector 114, then one or more electrical contacts of the first connector 114 may be coupled to the wire 126, for example as described with reference to FIG. 1A. Alternatively, if the particular application does not leave any unused (or "extra") electrical contacts of the first connector 114, then the wire 126 may be coupled to the tab 152, as described with reference to FIG. 1B (e.g., to "conserve" electrical contacts of the first connector 114).

One or more aspects of FIGS. 1A and 1B enable the plurality of shield conductors 108 to shield the plurality of primary conductors 104 in the presence of a malfunction. For example, in some circumstances, the shield termination device 112 may become mechanically or electrically separated from the first connector 114, such as due to loosening of the electrical coupler 140 or if the first set of teeth 128 is separated from the second set of teeth 130. In this case, the wire 126 provides an electrical connection from the plurality of shield conductors 108 (and the shield termination device 112) to the second electrical contact 124 or to the tab 152, maintaining shielding of the plurality of shield conductors 108.

Figure 2:
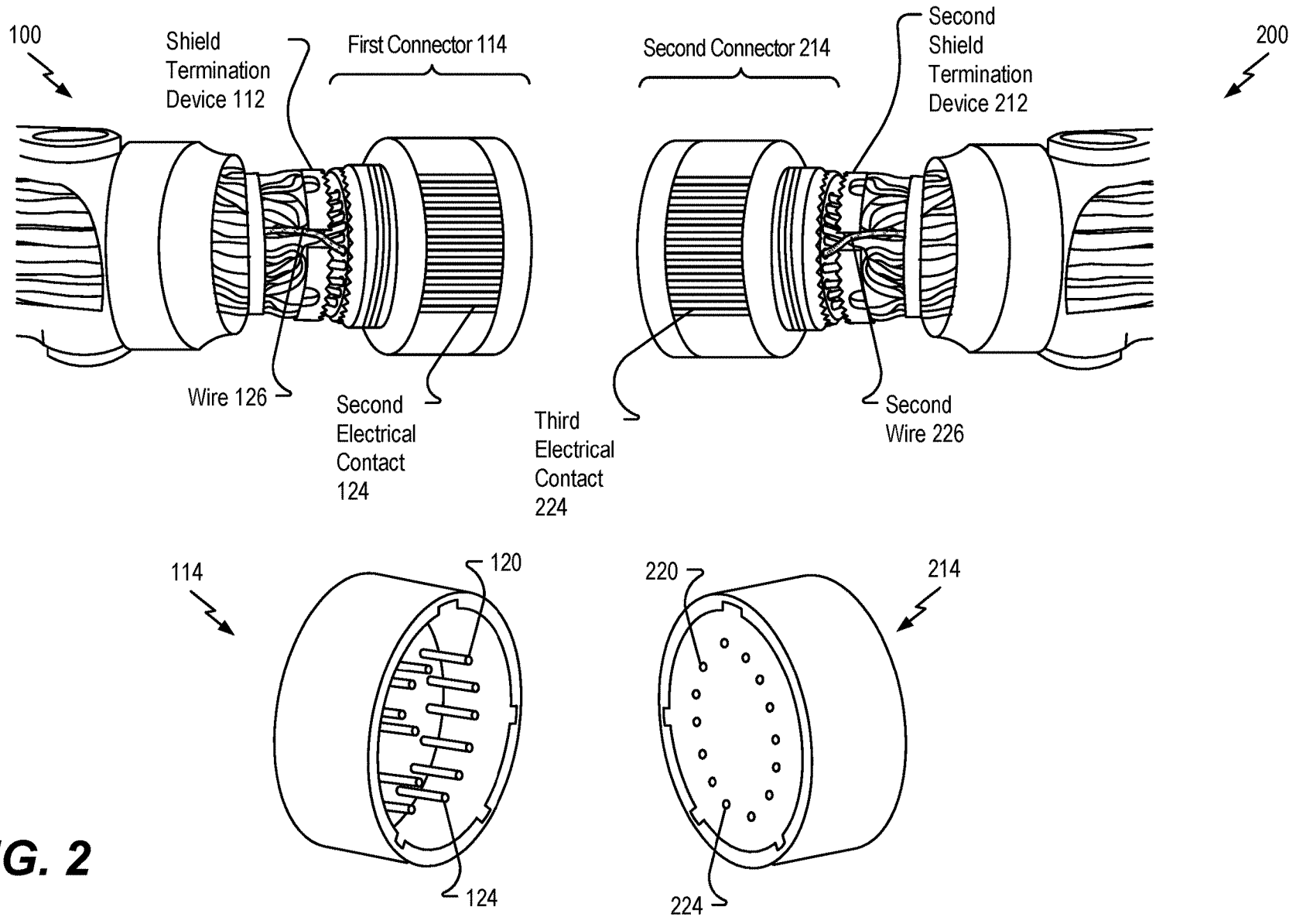
FIG. 2 is a diagram that illustrates aspects of the connector of FIG. 1A and a second connector.

FIG. 2 illustrates aspects of a system that includes the apparatus 100 and an apparatus 200. The apparatus 200 includes many of the same features and components as the apparatus 100 of FIG. 1A. For example, in some implementations, the apparatus 200 includes a second connector 214 that corresponds to the first connector 114. As additional examples, in some implementations, the apparatus 200 includes a third electrical contact 224 corresponding to the second electrical contact 124 and also includes a second shield termination device 212 corresponding to the shield termination device 112. FIG. 2 also depicts that the apparatus 200 includes a second wire 226 coupled to the third electrical contact 224 and to the second shield termination device 212. Further, it is noted that in FIG. 2 the wires 126, 226 may be coupled to tabs (e.g., as described with reference to the tab 152 of FIG. 1B) instead of being coupled to electrical contacts.

The second shield termination device 212 is electrically connected to the second connector 214. For example, the second wire 226 electrically connects the second shield termination device 212 to the third electrical contact 224 of the second connector 214. Alternatively or in addition, in some implementations, the second shield termination device 212 is in contact with the second connector 214, such as using sets of teeth, as described with reference to the sets of teeth 128, 130 of FIG. 1A, using a tab arrangement, using one or more other techniques, or a combination thereof.

In some implementations, the first connector 114 is configured to attach to the second connector 214. To illustrate, in some examples, the first connector 114 is configured to screw to the second connector 214. Alternatively or in addition, in some implementations, the first connector 114 is configured to attached to the second connector 214 using one or more other techniques, such as by plugging the second connector 214 into the first connector 114 (or vice versa).

Upon attaching the first connector 114 to the second connector 214, the second electrical contact 124 provides a current path from the shield termination device 112 to the second shield termination device 212. In some examples, the current path includes the plurality of shield conductors 108, the shield termination device 112, the wire 126, the second electrical contact 124, the third electrical contact 224, the second wire 226, the second shield termination device 212, and a plurality of shield conductors of the apparatus 200.

To further illustrate, FIG. 2 depicts an example in which electrical contacts of the first connector 114 include "pins." In this example, the first plurality of electrical contacts of the first connector 114 (e.g., the electrical contacts 120, 124) include a plurality of pins, and a second plurality of electrical contacts of the second connector 214 (e.g., the third electrical contact 224 and a fourth electrical contact 220) include a plurality of receptacles configured to connect to the plurality of pins. In an alternative implementation, the first plurality of electrical contacts include a plurality of receptacles, and the second plurality of electrical contacts include a plurality of pins configured to connect to the plurality of receptacles.

One or more aspects of FIG. 2 enable the plurality of shield conductors 108 to shield the plurality of primary conductors 104 from electromagnetic interference. For example, in some circumstances, the shield termination device 112 may become mechanically or electrically separated from the first connector 114, such as due to loosening of the electrical coupler 140 or if the first set of teeth 128 is separated from the second set of teeth 130. In this case, the wire 126 provides an electrical connection from the plurality of shield conductors 108 (and the shield termination device 112) to the second electrical contact 124, maintaining shielding of the plurality of shield conductors 108.

As another example, in some circumstances, the second shield termination device 212 may become mechanically or electrically separated from the second connector 214. In this case, the second wire 226 provides an electrical connection from the second shield termination device 212 to the third electrical contact 224, maintaining shielding of a plurality of shield conductors coupled to the second connector 214.

Figure 3:
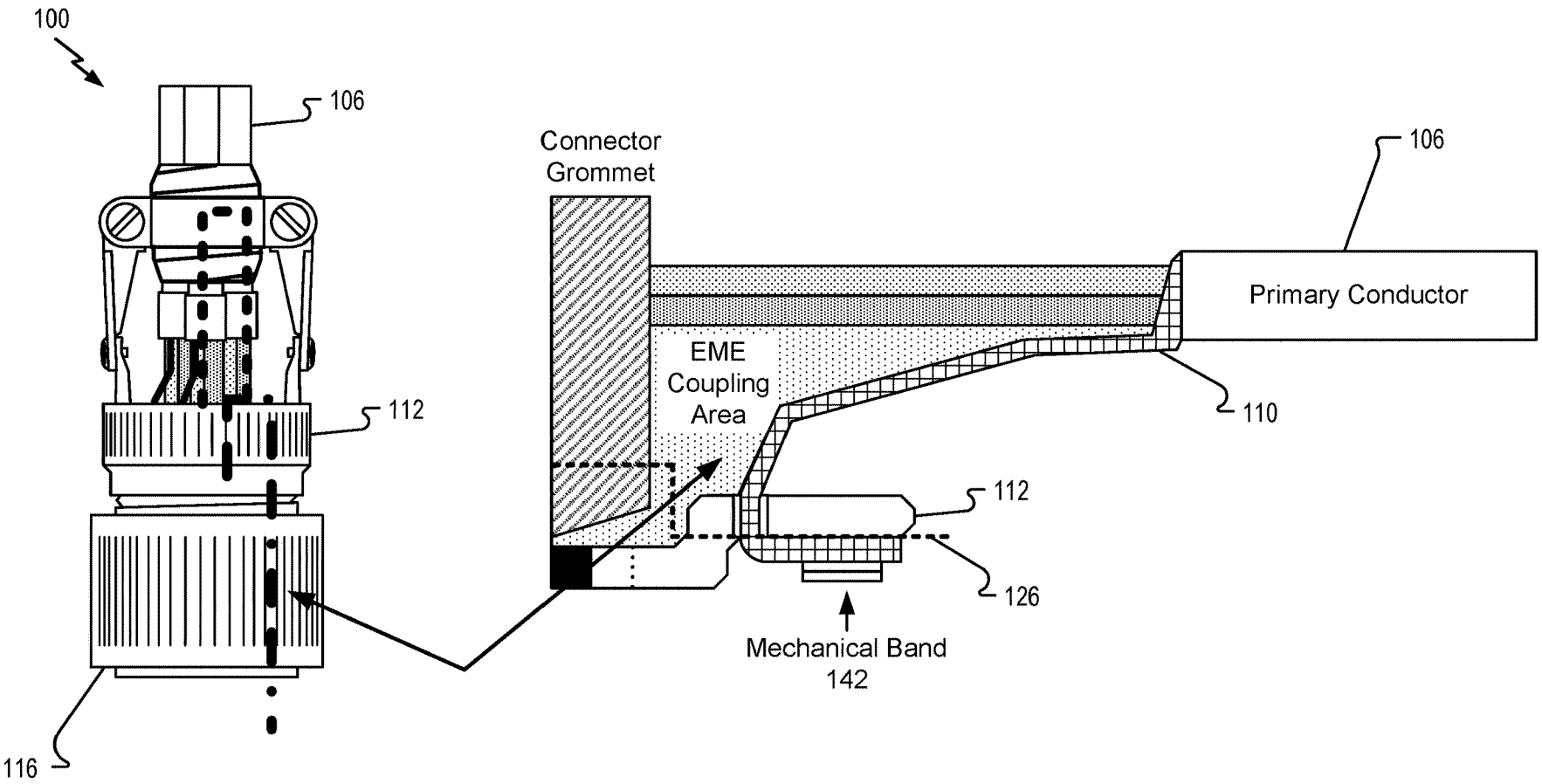
FIG. 3 is a diagram that illustrates additional aspects of the connector of FIG. 1A.

FIG. 3 depicts additional illustrative aspects of the apparatus 100. Although the example of FIG. 3 is described with reference to the apparatus 100, it is noted that aspects of FIG. 3 may be implemented at the apparatus 150 or the apparatus 200 (alternatively or in addition to the apparatus 100).

In the example of FIG. 3, the wire 126 is in contact with the shield termination device 112. Further, the shield termination device 112 is in contact with the shield conductor 110 that is attached to the primary conductor 106. In some implementations, the wire 126 is attached to the mechanical band 142.

Figure 4:
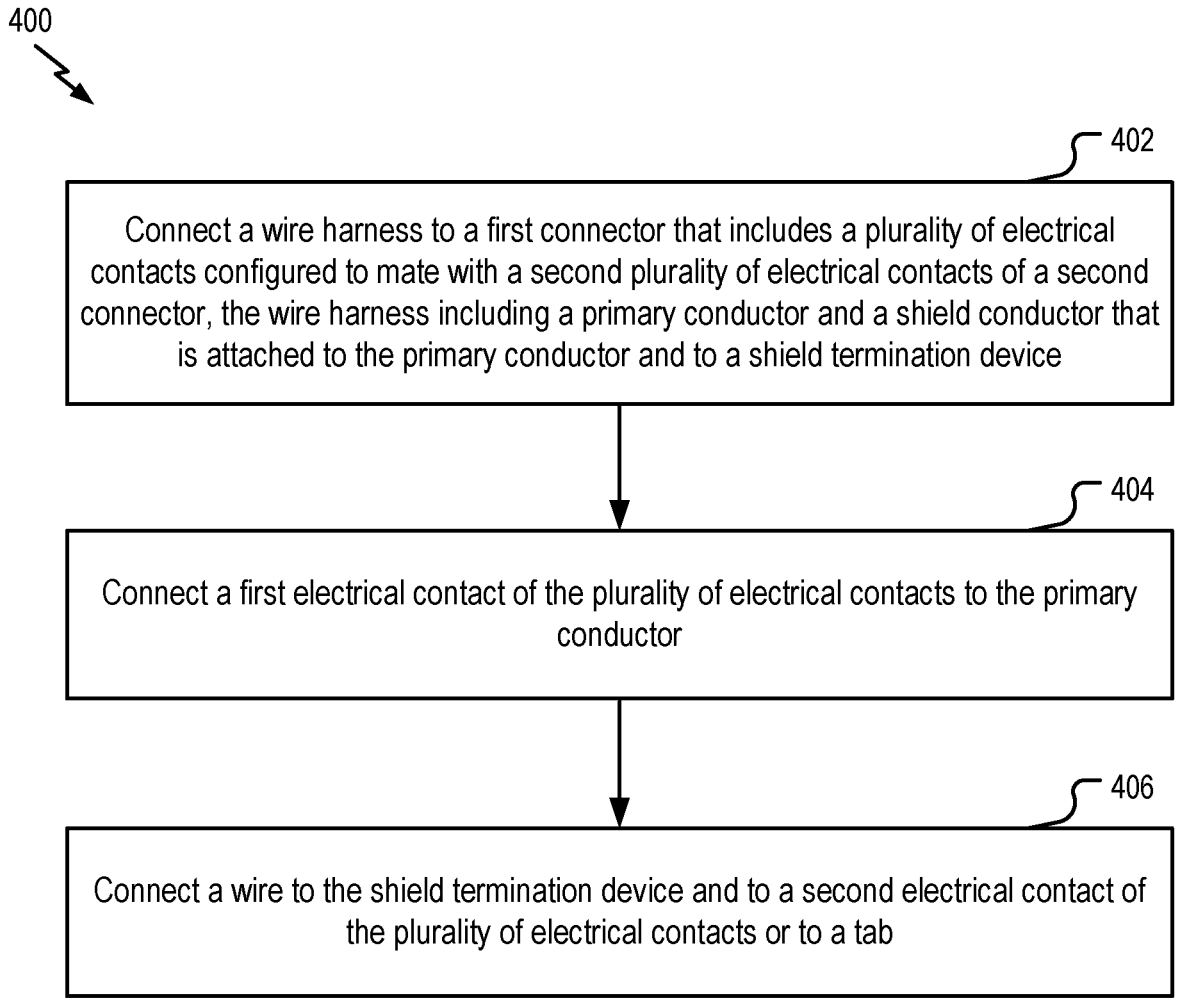
FIG. 4 is a flow chart of an example of a method of fabricating a connector that includes a contact coupled to a shield of a conductor.

Referring to FIG. 4, aspects of an example of a method of fabricating a connector that includes a contact coupled to a shield of a conductor are depicted and generally designated 400. In a particular example, the method 400 is performed to fabricate the first connector 114. In other examples, the method 400 is performed to fabricate another connector, such as the second connector 214, one or more other connectors, or a combination thereof.

The method 400 includes connecting a wire harness to a first connector that includes a plurality of electrical contacts configured to mate with a second plurality of electrical contacts of a second connector, at 402. In a particular example, connecting the wire harness to the first connector includes mechanically connecting the wire harness to the first connector. For example, in some implementations, the wire harness 102 is connected to the first connector 114 by connecting the first set of teeth 128 to the second set of teeth 130, as an illustrative example. Alternatively or in addition, in some implementations, the wire harness 102 is connected to the first connector 114 using the electrical coupler 140 (e.g., to secure the first set of teeth 128 to the second set of teeth 130). The wire harness includes a primary conductor and a shield conductor that is attached to the primary conductor and to a shield termination device. For example, the wire harness 102 includes the primary conductor 106 and the shield conductor 110 that is attached to the primary conductor 106 and to the shield termination device 112.

The method 400 further includes connecting a first electrical contact of the plurality of electrical contacts to the primary conductor, at 404. For example, the first electrical contact 120 is connected to the primary conductor 106, such as by soldering, crimping, or press fitting the first electrical contact 120 to the primary conductor 106, as illustrative examples.

The method 400 further includes connecting a wire to the shield termination device and to a second electrical contact of the plurality of electrical contacts or to a tab, at 406. In a particular example, the wire 126 connects the second electrical contact 124 to the shield termination device 112. In a particular example, connecting the second electrical contact 124 to the shield termination device 112 includes attaching (e.g., soldering) the wire 126 to the second electrical contact 124 and to the shield termination device 112. In some examples, the second electrical contact 124 includes a pin, and attaching the wire 126 includes soldering the wire 126 to the pin. In another example, the second electrical contact 124 includes a receptacle, and attaching the wire 126 includes soldering the wire 126 to the receptacle. In another implementation, the wire 126 is connected to the shield termination device 112 and to the tab 152, such as described with reference to FIG. 1B. Connecting the wire 126 to one or both of the shield termination device 112 and the tab 152 may include soldering, crimping, or press fitting the wire 126, as illustrative examples.

A device fabricated in accordance with or more aspects of FIG. 4 enables shielding in the presence of a malfunction. For example, in some circumstances, the electrical coupler 140 may become mechanically separated. In this case, shield continuity is maintained (e.g., using the wire 126).

Figure 5:
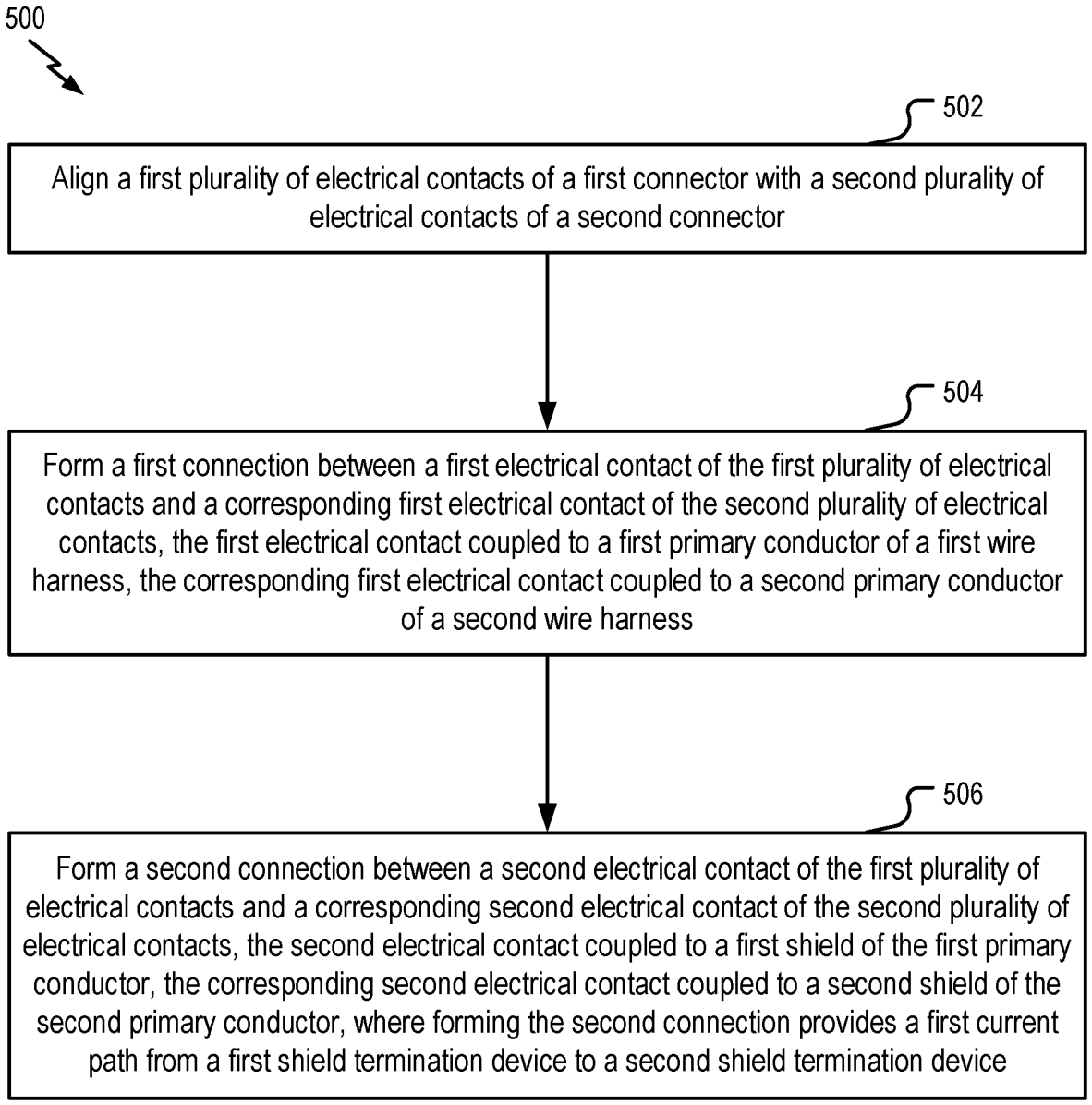
FIG. 5 is a flow chart of an example of a method of connecting components using a connector that includes a contact coupled to a shield of a conductor.

Referring to FIG. 5, aspects of an example of a method of connecting components using a connector that includes a contact coupled to a shield of a conductor are depicted and generally designated 500. In a particular example, the method 500 is performed to attach the first connector 114 to the second connector 214.

The method 500 includes aligning a first plurality of electrical contacts of a first connector with a second plurality of electrical contacts of a second connector, at 502. For example, in some implementations, the electrical contacts 120, 124 of the first connector 114 are aligned with the electrical contacts 220, 224 of the second connector 214.

The method 500 further includes forming a first connection between a first electrical contact (e.g., the first electrical contact 120) of the first plurality of electrical contacts and a corresponding first electrical contact (e.g., the fourth electrical contact 220) of the second plurality of electrical contacts, at 504. The first electrical contact is coupled to a first primary conductor (e.g., the primary conductor 106) of a first wire harness (e.g., the wire harness 102), and the corresponding first electrical contact is coupled to a second primary conductor of a second wire harness (e.g., a second primary conductor and a second wire harness that are included in the apparatus 200).

The method 500 further includes forming a second connection between a second electrical contact (e.g., the second electrical contact 124) of the first plurality of electrical contacts and a corresponding second electrical contact (e.g., the third electrical contact 224) of the second plurality of electrical contacts, at 506. The second electrical contact coupled to a first shield (e.g., the shield conductor 110) of the first primary conductor, and the corresponding second electrical contact coupled to a second shield of the second primary conductor (e.g., a second shield conductor that is included in the apparatus 200). Forming the second connection provides a first current path from a first shield termination device (e.g., the shield termination device 112) to a second shield termination device (e.g., the second shield termination device 212).

In some implementations, the method 500 further includes attaching (e.g., screwing) the first connector to the second connector to form a mechanical connection between the first connector and the second connector. For example, in some implementations, the first connector 114 is attached (e.g., screwed) to the second connector 214 to mechanically connect the first connector 114 to the second connector 214. In some examples, the mechanical connection forms a second current path from the first shield termination device to the second shield termination device. In some examples, the first current path is electrically conductive independently of the mechanical connection (e.g., where the first current path remains electrically conductive in the event that the first connector 114 is separated from the second connector 214). In some examples, as long as signals associated with primary conductors remain functional, shield continuity is maintained across the connector pair.

A device connected in accordance with or more aspects of FIG. 5 enables shielding in the presence of a malfunction. For example, in some circumstances, the electrical coupler 140 may become mechanically separated (or "loose"). In this case, shield continuity is maintained (e.g., using the wire 126).

Figure 6:
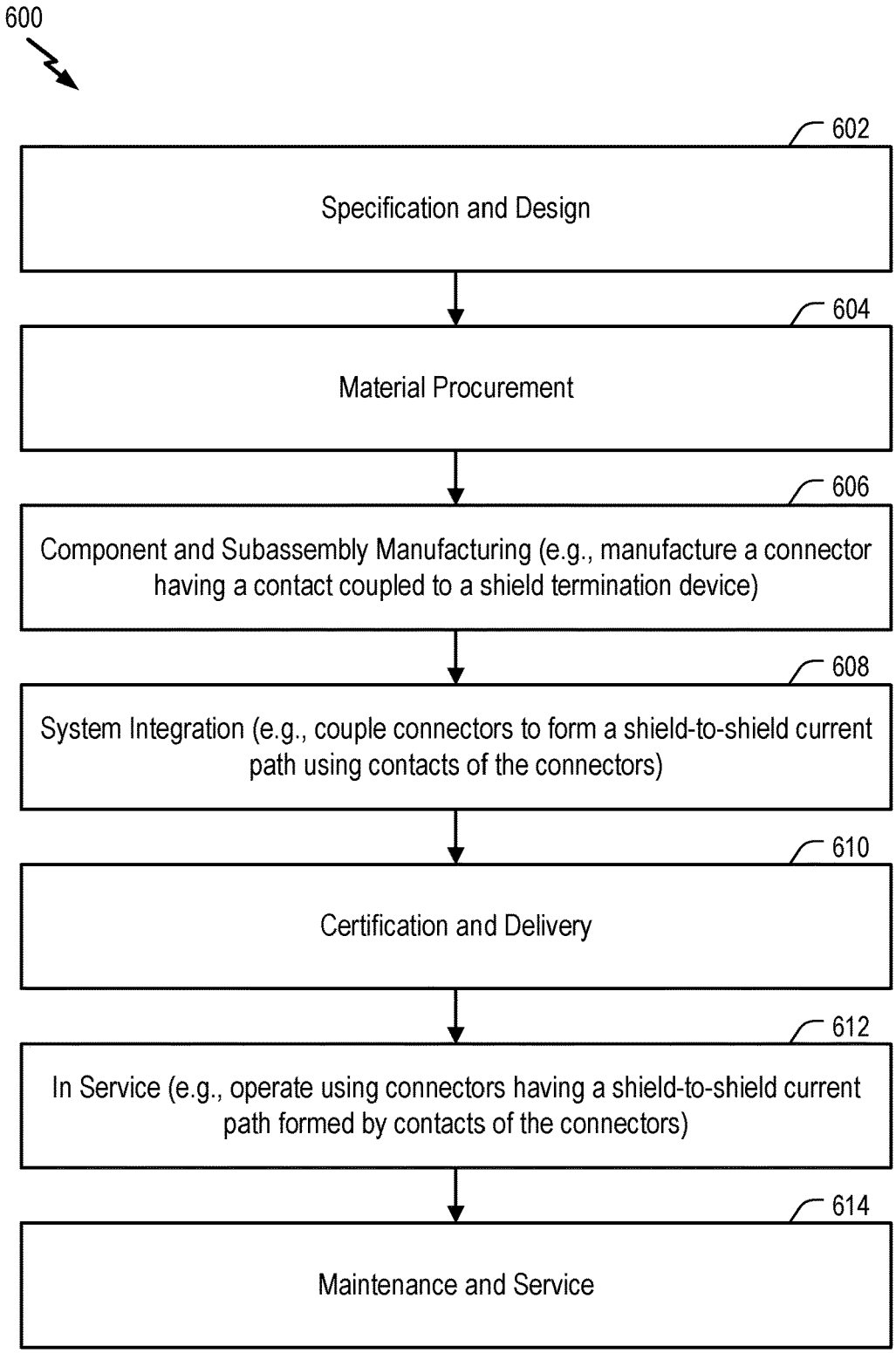
FIG. 6 is a flow chart of an example of a life cycle of a vehicle including a connector including a contact coupled to a shield of a conductor.

Referring to FIG. 6, a flowchart of an illustrative example of a life cycle of a vehicle (e.g., an aircraft) including a connector including a contact coupled to a shield of a conductor is depicted and generally designated 600. The vehicle may include the first connector 114, the second connector 214, one or more other connectors, or a combination thereof.

During pre-production, the exemplary method 600 includes specification and design of the vehicle, at 602. During the specification and design of the vehicle, the method 600 includes specifying components, such as the first connector 114, the shield termination device 112, and the wire harness 102.

At 604, the method 600 includes material procurement. For example, the method 600 may include procuring materials (such as materials for the first connector 114, the shield termination device 112, and the wire harness 102) for the vehicle.

During production, the method 600 includes, at 606, component and subassembly manufacturing and, at 608, system integration of the vehicle. In some implementations, component and subassembly includes one or more operations of the method 400 of FIG. 4, and system integration includes one or more operations of the method 500 of FIG. 5.

The method 600 includes certification and delivery of the vehicle, at 610, and placing the vehicle in service, at 612. In some implementations, service of the vehicle may include operating using electrical connections formed using the connectors 114, 214.

While in service, the vehicle may be scheduled for routine maintenance and service (which may also include modification, reconfiguration, refurbishment, and so on). At 614, the method 600 includes performing maintenance and service on the vehicle. To illustrate, in some examples, performing maintenance and service may include inspecting and servicing a connection between the connectors 114, 214.

Figure 7:
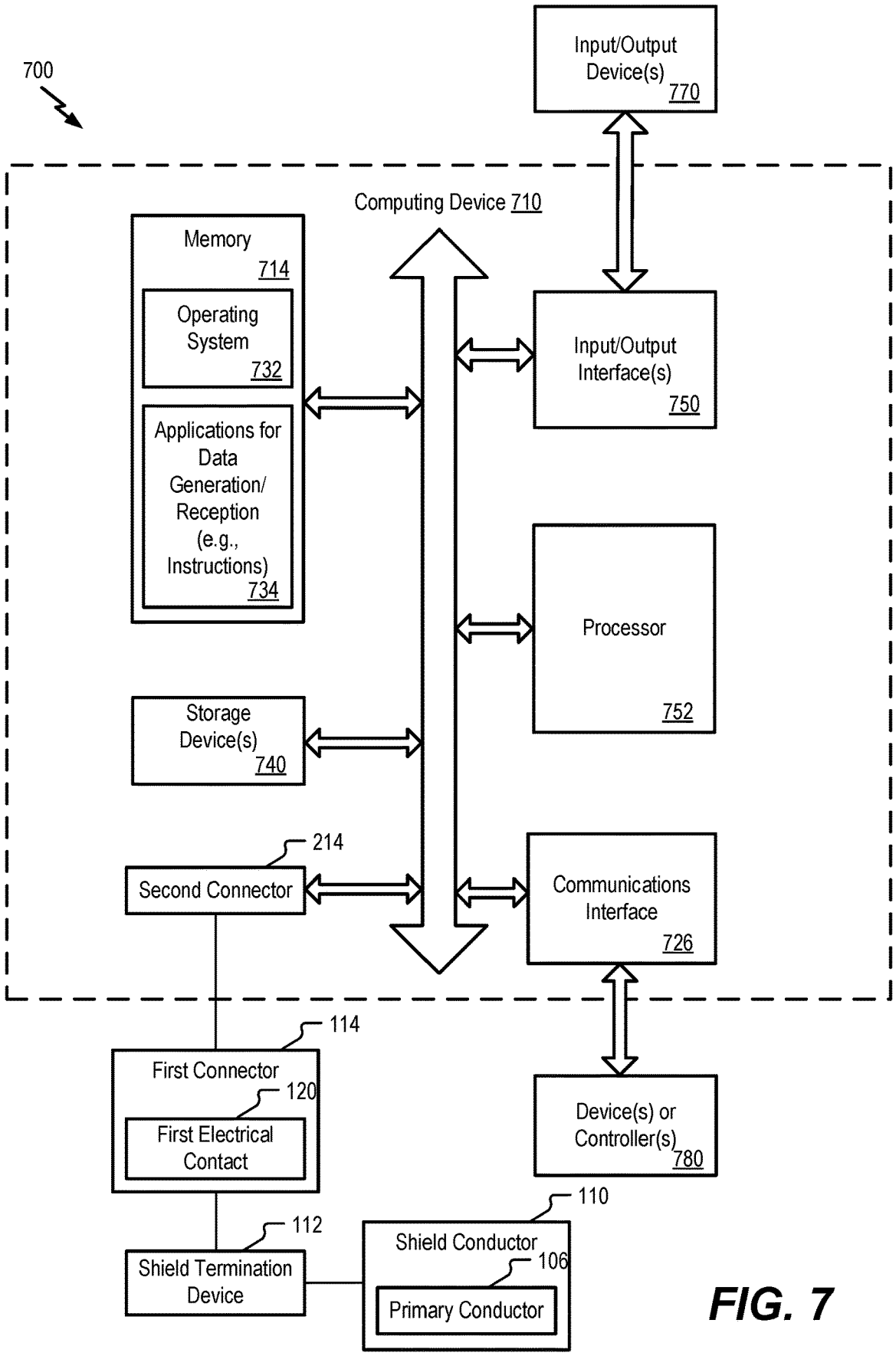
FIG. 7 is a block diagram illustrating aspects of an example of a computing system that includes a connector having a contact coupled to a shield of a conductor.

FIG. 7 is an illustration of a block diagram of a computing environment 700 including a computing device 710 (e.g., a general-purpose computing device) configured to support embodiments of computer-implemented methods and computer-executable program instructions (or code) according to the present disclosure. For example, the computing device 710, or portions thereof, may execute instructions to perform or initiate the functions of a vehicle that includes the first connector 114, the second connector 214, or both.

The computing device 710 includes a processor 752. The processor 752 may communicate with a memory 714 (e.g., a system memory), one or more storage devices 740, one or more input/output interfaces 750, a communications interface 726, or a combination thereof.

The memory 714 may include volatile memory devices (e.g., random access memory (RAM) devices), nonvolatile memory devices (e.g., read-only memory (ROM) devices, programmable read-only memory, and flash memory), or both. The memory 714 may include an operating system 732, which may include a basic/input output system for booting the computing device 710 as well as a full operating system to enable the computing device 710 to interact with users, other programs, and other devices. The memory 714 may include one or more applications 734 which may be executable by the processor 752. For example, the one or more applications 734 may include instructions executable by the processor 752 to transmit signals between components of the computing device 710, such as the memory 714, the one or more storage devices 740, the one or more input/output interfaces 750, the communications interface 726, or a combination thereof.

The one or more storage devices 740 may include nonvolatile storage devices, such as magnetic disks, optical disks, or flash memory devices. The one or more storage devices 740 may include both removable and non-removable memory devices. The one or more storage devices 740 may be configured to store an operating system, images of operating systems, applications, and program data. In a particular example, the memory 714, the one or more storage devices 740, or both, include tangible computer-readable media.

In the example of FIG. 7, the computing device 710 includes one or more connectors, such as the second connector 214. The second connector 214 can be coupled to one or more components or devices, such as one or more components or devices that are external to the computing device 710. The example of FIG. 7 illustrates that the second connector 214 is coupled to the first connector 114. FIG. 7 also illustrates that the first connector 114 is coupled to the shield conductor 110 via the shield termination device 112.

The processor 752 may communicate with the one or more input/output interfaces 750 to enable the computing device 710 to communicate with one or more input/output devices 770 to facilitate user interaction. The one or more input/output interfaces 750 may include serial interfaces (e.g., universal serial bus (USB) interfaces or Institute of Electrical and Electronics Engineers (IEEE) 1394 interfaces), parallel interfaces, display adapters, audio adapters, and other interfaces. The one or more input/output devices 770 may include keyboards, pointing devices, displays, speakers, microphones, touch screens, and other devices. The processor 752 may detect interaction events based on user input received via the one or more input/output interfaces 750. Additionally, the processor 752 may send a display to a display device via the one or more input/output interfaces 750. In some implementations, the one or more input/output devices 770 are coupled to the processor 752 via the connectors 114, 214.

The processor 752 may communicate with (or send signals to) one or more devices 780 using the communications interface 726. The communications interface 726 may include one or more wired interfaces (e.g., Ethernet interfaces), one or more wireless interfaces that comply with an IEEE 802.11 communication protocol, other wireless interfaces, optical interfaces, or other network interfaces. The one or more devices 780 may include host computers, servers, workstations, and other computing devices. In some implementations, the one or more devices 780 are coupled to the processor 752 via the connectors 114, 214.

Figure 8:
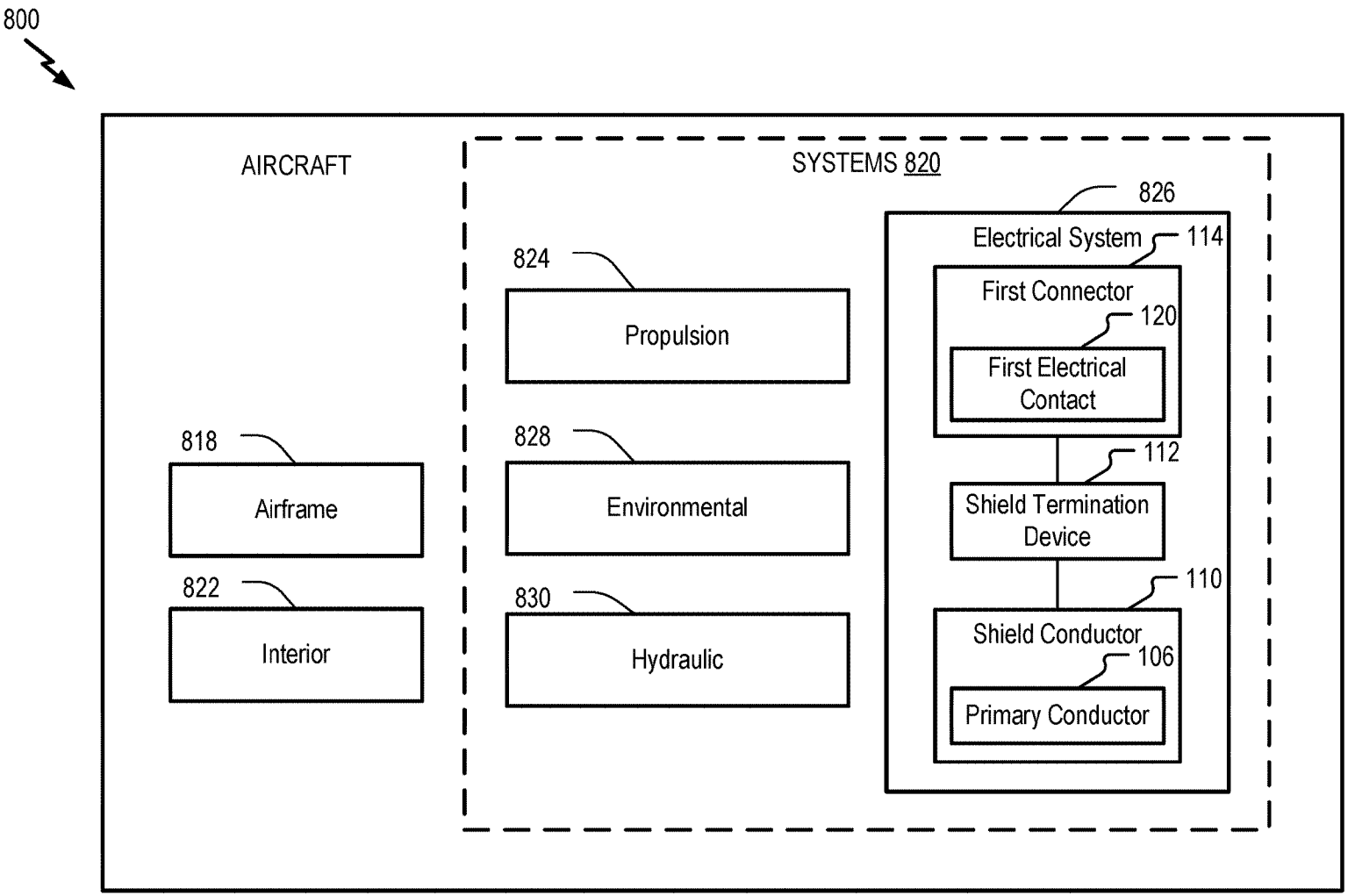
FIG. 8 is a block diagram illustrating aspects of an illustrative implementation of an aircraft that includes a connector having a contact coupled to a shield of a conductor.

Aspects of the disclosure may be described in the context of an example of an aircraft 800 as shown in FIG. 8. In some examples, the aircraft 800 corresponds to the vehicle described with reference to FIG. 6.

The aircraft 800 includes an electrical system 826. In the example of FIG. 8, the electrical system 826 includes the first connector 114, the shield termination device 112, and the shield conductor 110. The first connector 114 includes the first electrical contact 120, and the shield conductor is configured to shield the primary conductor 106.

As shown in FIG. 8, the aircraft 800 includes an airframe 818 with a plurality of systems 820 and an interior 822. Examples of the plurality of systems 820 include one or more of a propulsion system 824, the electrical system 826, an environmental system 828, and a hydraulic system 830. Any number of other systems may be included.

The illustrations of the examples described herein are intended to provide a general understanding of the structure of the various implementations. The illustrations are not intended to serve as a complete description of all of the elements and features of apparatus and systems that utilize the structures or methods described herein. Many other implementations may be apparent to those of skill in the art upon reviewing the disclosure. Other implementations may be utilized and derived from the disclosure, such that structural and logical substitutions and changes may be made without departing from the scope of the disclosure. For example, method operations may be performed in a different order than shown in the figures or one or more method operations may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific implementations shown. This disclosure is intended to cover any and all subsequent adaptations or variations of various implementations. Combinations of the above implementations, and other implementations not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single implementation for the purpose of streamlining the disclosure. Examples described above illustrate, but do not limit, the disclosure. It should also be understood that numerous modifications and variations are possible in accordance with the principles of the present disclosure. As the following claims reflect, the claimed subject matter may be directed to less than all of the features of any of the disclosed examples. Accordingly, the scope of the disclosure is defined by the following claims and their equivalents.

What is claimed is:

1. An apparatus comprising:

a wire harness including a primary conductor and a shield conductor configured to electromagnetically shield the primary conductor; and a first connector coupled to the wire harness, the first connector including:

a shield termination device electrically connected to the shield conductor;

a connector body defining a plurality of openings to receive a first plurality of electrical contacts, the first plurality of electrical contacts configured to mate with a second plurality of electrical contacts of a second connector;

a first electrical contact of the first plurality of electrical contacts positioned in a first opening of the connector body and electrically connected to the primary conductor; and a second electrical contact of the first plurality of electrical contacts positioned in a second opening of the connector body and electrically connected to the shield termination device.

2. The apparatus of claim 1, wherein the second electrical contact provides a current path from the shield termination device to a second shield termination device electrically connected to the second connector.

3. The apparatus of claim 1, wherein the shield termination device includes a first set of teeth configured to mate with a second set of teeth of the first connector and to provide a current path from the shield conductor to a second shield conductor electrically connected to the second connector.

4. The apparatus of claim 1, wherein the first plurality of electrical contacts includes a plurality of pins, and wherein the second plurality of electrical contacts include a plurality of receptacles configured to connect to the plurality of pins.

5. The apparatus of claim 1, wherein the first plurality of electrical contacts includes a plurality of receptacles, and wherein the second plurality of electrical contacts include a plurality of pins configured to connect to the plurality of receptacles.

6. The apparatus of claim 1, wherein the wire harness includes a plurality of shield conductors including the shield conductor, and wherein each shield conductor of the plurality of shield conductors is electrically connected to the shield termination device.

7. The apparatus of claim 1, wherein the wire harness includes a plurality of primary conductors including the primary conductor, and wherein each primary conductor of the plurality of primary conductors is electrically connected to a respective electrical contact positioned in a corresponding opening of the connector body.

8. The apparatus of claim 1, further comprising a wire coupled to the second electrical contact and to the shield termination device, wherein the wire and the second electrical contact have sizes selected to provide a single current path for all shield conductors of the wire harness.

9. The apparatus of claim 1, wherein the shield conductor includes a wire mesh configured to electromagnetically shield the primary conductor from one or more of a lightning strike, a high-intensity electromagnetic field, an electromagnetic pulse, a radio signal, or another electromagnetic signal.

10. The apparatus of claim 1, wherein the first connector is configured to screw to the second connector.

11. An apparatus comprising:

a primary conductor;

a shield conductor configured to electromagnetically shield the primary conductor; and a first connector coupled to the primary conductor, the first connector including:

a shield termination device electrically connected to the shield conductor;

a connector body defining a plurality of openings to receive a first plurality of electrical contacts, the first plurality of electrical contacts configured to mate with a second plurality of electrical contacts of a second connector;

a first electrical contact of the first plurality of electrical contacts positioned in a first opening of the connector body and electrically connected to the primary conductor; and a second electrical contact of the first plurality of electrical contacts positioned in a second opening of the connector body and electrically connected to the shield termination device.

12. The apparatus of claim 11, wherein the second electrical contact provides a current path from the shield termination device to a second shield termination device electrically connected to the second connector.

13. A method comprising:

connecting a wire harness to a first connector, wherein the wire harness includes a primary conductor and a shield conductor configured to electromagnetically shield the primary conductor, and wherein the first connector includes a shield termination device electrically connected to the shield conductor, and a connector body defining a plurality of openings to receive a first plurality of electrical contacts, the first plurality of electrical contacts configured to mate with a second plurality of electrical contacts of a second connector;

connecting a first electrical contact of the first plurality of electrical contacts to the primary conductor, the first electrical contact positioned in a first opening of the plurality of openings; and connecting the shield termination device to a second electrical contact of the first plurality of electrical contacts, the second electrical contact positioned in a second opening of the plurality of openings.

14. The method of claim 13, wherein connecting the shield termination device to the second electrical contact comprises connecting a wire to the second electrical contact and to the shield termination device.

15. The method of claim 14, wherein the second electrical contact includes a pin, and wherein connecting the wire includes soldering the wire to the pin.

16. The method of claim 14, wherein the second electrical contact includes a receptacle, and wherein connecting the wire includes soldering the wire to the receptacle.

17. A method comprising:

aligning a first plurality of electrical contacts of a first connector with a second plurality of electrical contacts of a second connector, wherein the first connector includes a first shield termination device and a connector body defining a plurality of openings to receive the first plurality of electrical contacts;

forming a first connection between a first electrical contact of the first plurality of electrical contacts and a corresponding first electrical contact of the second plurality of electrical contacts, the first electrical contact positioned in a first opening of the connector body, the first electrical contact coupled to a first primary conductor of a first wire harness, and the corresponding first electrical contact coupled to a second primary conductor of a second wire harness, wherein the first wire harness includes the first primary conductor and a first shield conductor that electromagnetically shields the first primary conductor, the first shield conductor electrically coupled to the first shield termination device; and forming a second connection between a second electrical contact of the first plurality of electrical contacts and a corresponding second electrical contact of the second plurality of electrical contacts, the second electrical contact positioned in a second opening of the connector body and electrically connected to the first shield termination device, wherein forming the second connection provides a first current path from the first shield termination device to a second shield termination device.

18. The method of claim 17, further comprising screwing the first connector to the second connector to form a mechanical connection between the first connector and the second connector.

19. The method of claim 18, wherein the mechanical connection forms a second current path from the first shield termination device to the second shield termination device.

20. The method of claim 18, wherein the first current path is electrically conductive independent of the mechanical connection.

* * * * *